US009624719B2

(12) United States Patent
Rupel

(10) Patent No.: US 9,624,719 B2
(45) Date of Patent: Apr. 18, 2017

(54) CELL-IN CELL CONFIGURATIONS FOR A CELLULAR SHADE ASSEMBLY

(71) Applicant: Hunter Douglas, Inc., Pearl River, NY (US)

(72) Inventor: John D. Rupel, Pine River, WI (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 14/709,608

(22) Filed: May 12, 2015

(65) Prior Publication Data

US 2015/0322714 A1 Nov. 12, 2015

Related U.S. Application Data

(60) Provisional application No. 61/991,817, filed on May 12, 2014.

(51) Int. Cl.
*E06B 9/24* (2006.01)
*E06B 9/262* (2006.01)

(52) U.S. Cl.
CPC ..... *E06B 9/262* (2013.01); *E06B 2009/2627* (2013.01)

(58) Field of Classification Search
CPC ..... E06B 2009/2622; E06B 2009/2625; E06B 2009/2627
USPC ..... 160/84.05
See application file for complete search history.

(56) References Cited

U.S. PATENT DOCUMENTS 4,307,768 A * 12/1981 Anderson ..... E06B 9/262 160/5
4,388,354 A * 6/1983 Suominen ..... A47H 23/00 160/84.01
4,984,617 A * 1/1991 Corey ..... E06B 9/262 160/166.1
5,601,885 A * 2/1997 Akins ..... B29D 99/0089 156/197
5,897,731 A * 4/1999 Colson ..... B29C 65/08 156/197
6,052,966 A 4/2000 Colson et al.
7,192,633 B2 * 3/2007 Fransen ..... D03D 11/00 160/123

(Continued)

FOREIGN PATENT DOCUMENTS

GB 756270 9/1956

OTHER PUBLICATIONS

International Search Report and Written Opinion issued on Jul. 15, 2015, for International Patent Application No. PCT/US2015/030253, filed May 12, 2015, 18 pages.

*Primary Examiner* — Katherine Mitchell
*Assistant Examiner* — Abe Massad
(74) *Attorney, Agent, or Firm* — Dority & Manning, P.A.

(57) ABSTRACT

In one aspect, a cellular shade for an architectural opening may generally include a plurality of outer cells, with each outer cell including a first side and a second side extending between a first junction line and a second junction line. In addition, the cellular shade may include a first inner cell and a second inner cell defined within each outer cell between the first and second junction lines. The first inner cell may be formed from a first inner web forming a substantially closed shape defining a first internal cell area. The second inner cell may be formed from a second inner web forming a substantially closed shape defining a second internal cell area.

21 Claims, 9 Drawing Sheets

(56) References Cited

U.S. PATENT DOCUMENTS

| | | | | |
|---|---|---|---|---|
| 7,404,428 | B2 * | 7/2008 | Sun | E06B 9/262 156/197 |
| 8,256,488 | B2 * | 9/2012 | Ruggles | E04B 2/74 160/113 |
| 8,568,859 | B2 * | 10/2013 | Yu | B32B 3/04 160/115 |
| 8,915,288 | B2 * | 12/2014 | MacAllen | E04B 2/7416 160/351 |
| 2014/0168779 | A1 * | 6/2014 | Malkan | E06B 9/262 359/614 |

* cited by examiner

FIG. —3—

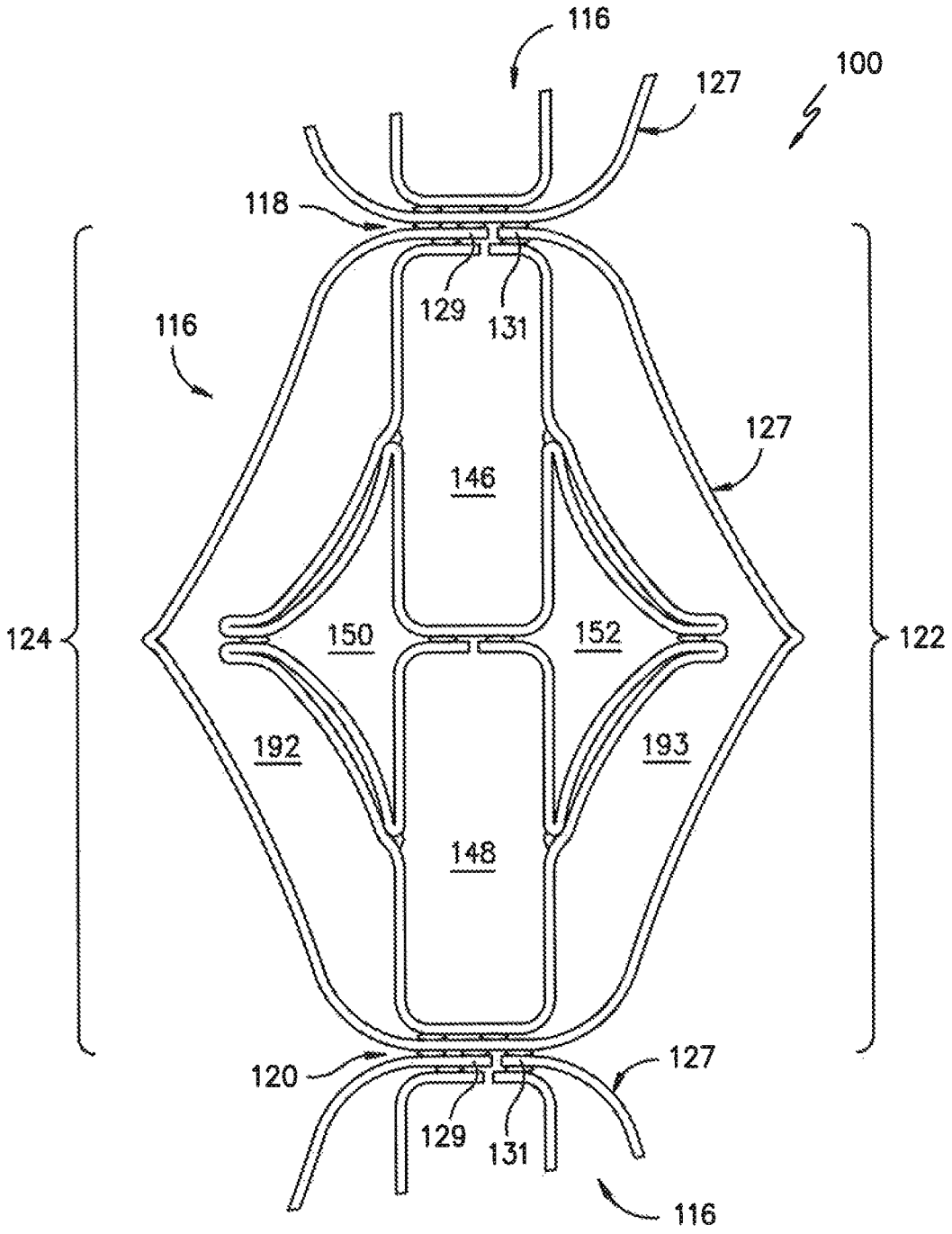
FIG. –5–

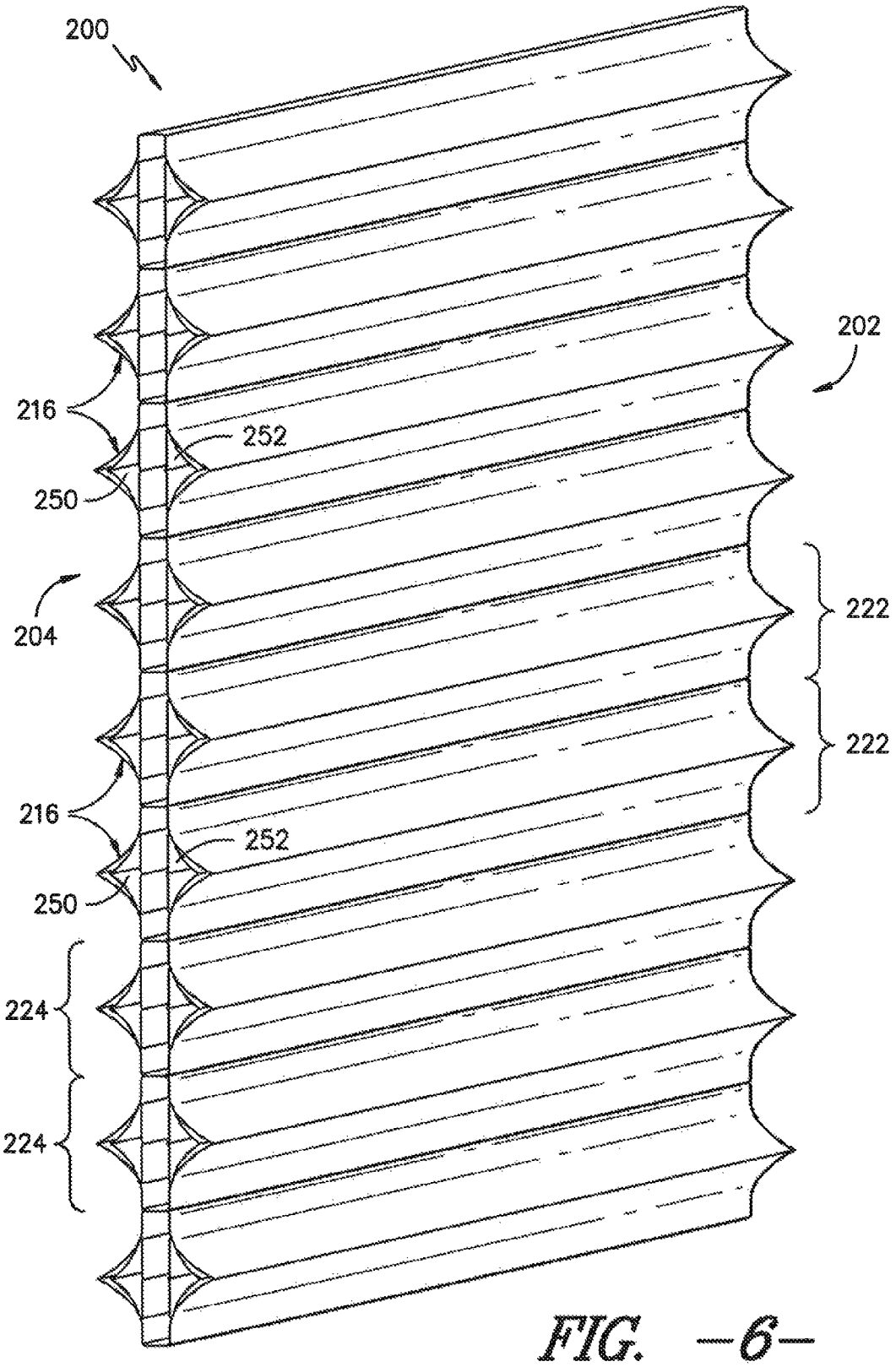
FIG. —6—

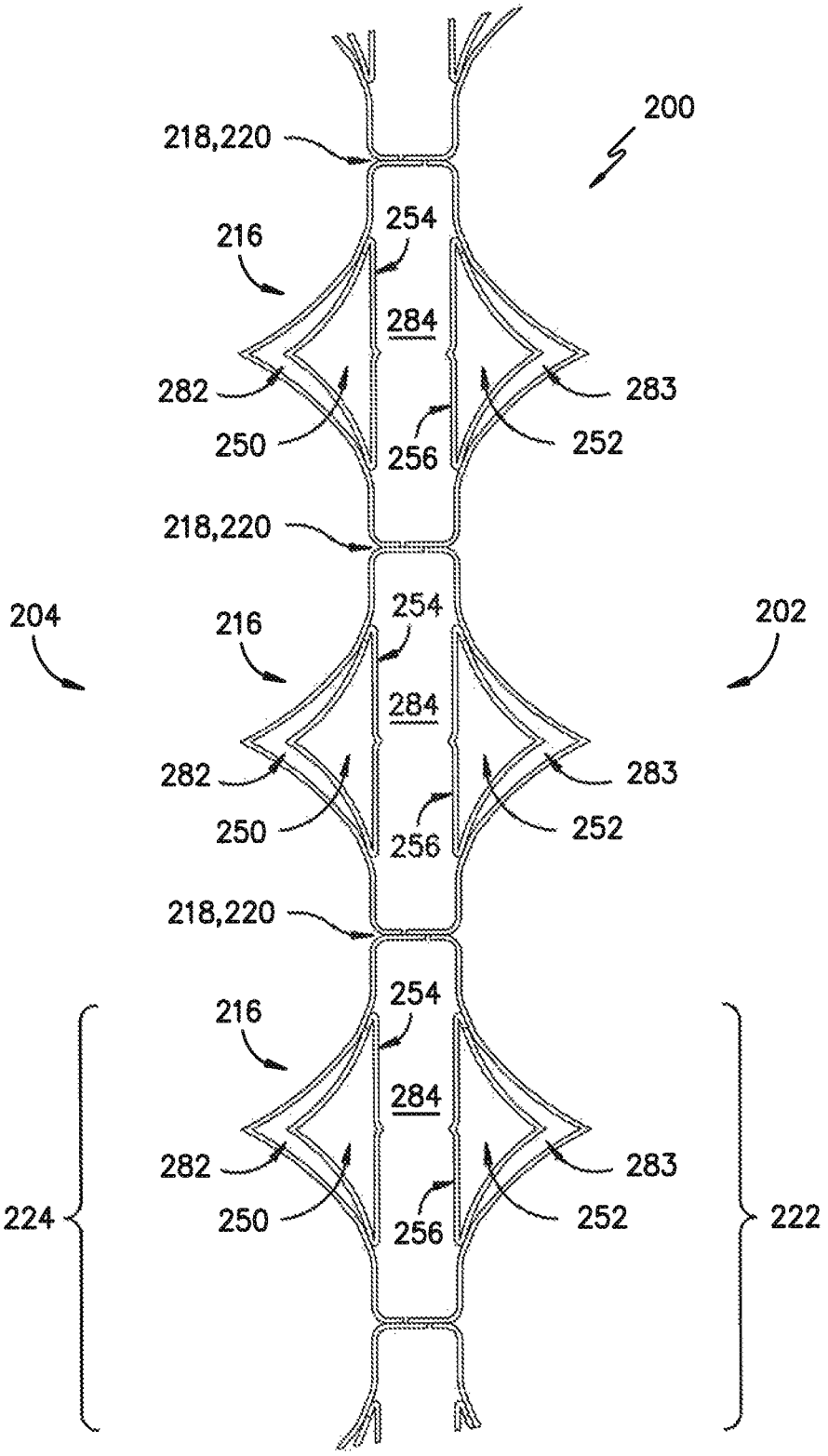
FIG. —7—

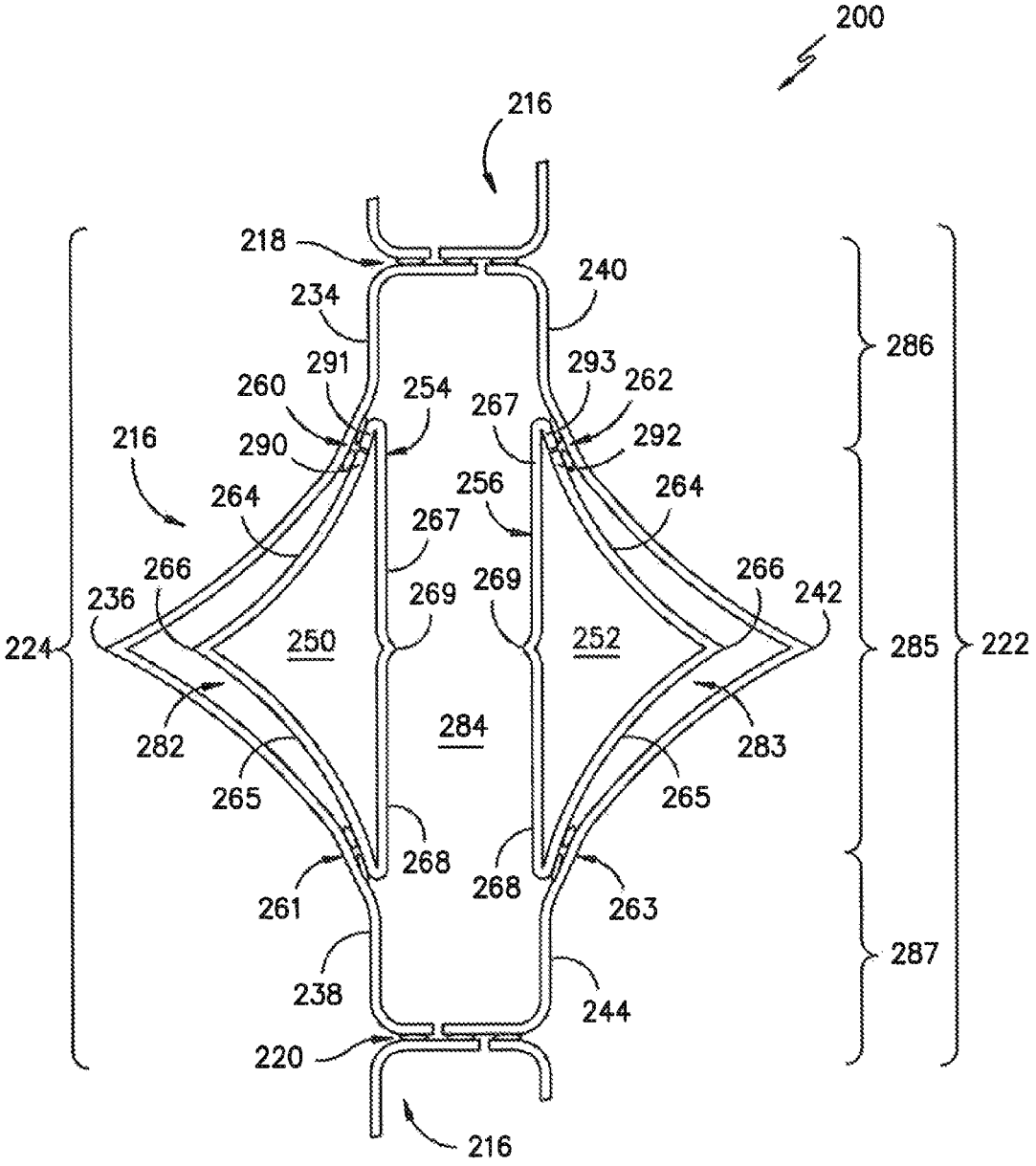
FIG. —8—

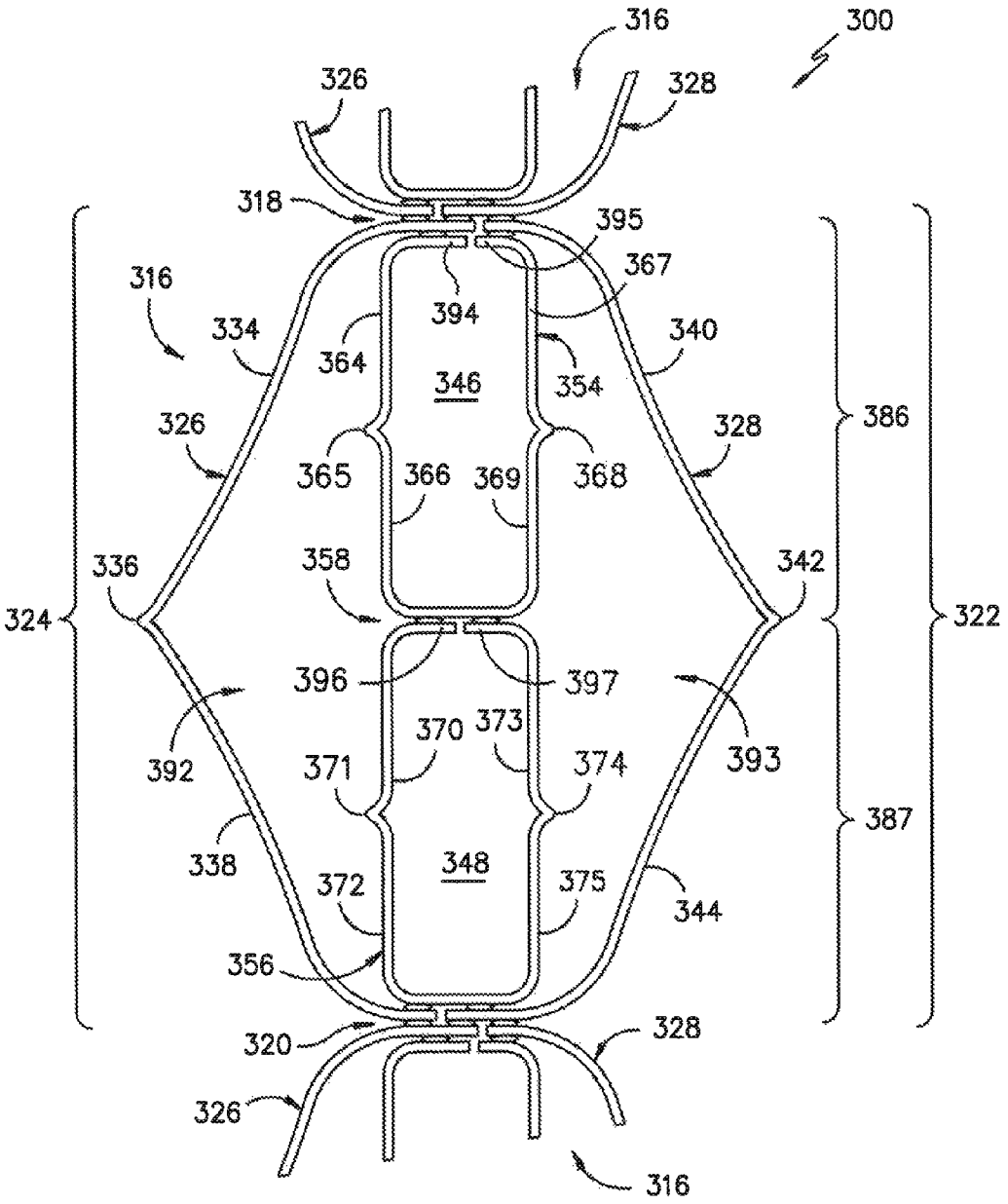
FIG. —9—

CELL-IN CELL CONFIGURATIONS FOR A CELLULAR SHADE ASSEMBLY

CROSS-REFERENCE TO RELATED APPLICATIONS

This application is based upon and claims priority to U.S. Provisional Patent Application No. 61/991,817, filed on May 12, 2014, the disclosure of which is hereby incorporated by reference herein in its entirety for all purposes.

FIELD OF THE INVENTION

The present subject matter relates generally to cellular shades and, more particularly, to various cell-in-cell configurations for a cellular shade assembly.

BACKGROUND OF THE INVENTION

Cellular shades have become a popular type of window covering in residential and commercial applications. The shades are aesthetically attractive and also provide improved insulation across a window or other type of opening due to their cellular construction. Cellular shades have assumed various forms, including a plurality of longitudinally extending tubes or cells made of a flexible or semi-rigid material. Cellular shades can, for instance, be mounted at the top of a door or window for extending across an architectural opening. When the shade is in an expanded state, the cells cover the opening. The shade can be retracted or drawn into a contracted state wherein the cells collapse into a stack.

The design emphasis in home and building structures has maintained pressure on the industry to continue to create unique aesthetically attractive coverings for architectural openings. Although the introduction of cellular shades has greatly benefited the industry in this regard, there remains a need to create cellular shades having a unique appearance for providing further design options to consumers while still providing the various functional characteristics such consumers have come to expect with cellular shapes (e.g., light blocking/filtering characteristics and/or insulation characteristics).

BRIEF DESCRIPTION OF THE INVENTION

Aspects and advantages of the invention will be set forth in part in the following description, or may be obvious from the description, or may be learned through practice of the invention.

In one aspect, the present subject matter is directed to a cellular shade for an architectural opening that is movable between an extended position and a retracted position. The cellular shade may generally include a plurality of outer cells vertically arranged with respect to one another. Each outer cell may include a first side and a second side extending between a first junction line and a second junction line. In addition, the cellular shade may include a first inner cell and a second inner cell defined within each outer cell between the first and second junction lines. The first inner cell may include a first plurality of wall segments formed from a first inner web, with such wall segments forming a substantially closed shape defining a first internal cell area. The second inner cell may include a second plurality of wall segments formed from a second inner web, with such wall segments forming a substantially closed shape defining a second internal cell area. Moreover, the first and second internal cell areas may be exclusive of one another.

In another aspect, the present subject matter is directed to a cellular shade for an architectural opening that is movable between an extended position and a retracted position. The cellular shade may generally include a plurality of outer cells vertically arranged with respect to one another, with each outer cell including a first side and a second side extending in a heightwise direction of the cellular shade between a first junction line and a second junction line. In addition, the cellular shade may include a first inner cell and a second inner cell defined within each outer cell between the first and second junction lines. The first inner cell may include a first plurality of wall segments forming a substantially closed shape defining a first internal cell area and the second inner cell may include a second plurality of wall segments forming a substantially closed shape defining a second internal cell area, with the first and second internal cell areas being exclusive of one another. Moreover, the first and second inner cells may be vertically arranged with respect to one another in the heightwise direction of the cellular shade.

In a further aspect, the present subject matter is directed to a cellular shade for an architectural opening that is movable between an extended position and a retracted position. The cellular shade may generally include a plurality of outer cells vertically arranged with respect to one another, with each outer cell including a first side and a second side extending in a heightwise direction of the cellular shade between a first junction line and a second junction line. In addition, the cellular shade may include a first inner cell and a second inner cell defined within each outer cell between the first and second junction lines. The first inner cell may include a first plurality of wall segments forming a substantially closed shape and the second inner cell may include a second plurality of wall segments forming a substantially closed shape. Moreover, the first and second inner cells may be oriented relative to one another within each outer cell such that differing light transmission bands are formed along the heightwise direction of the cellular shade as light passes therethrough.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 illustrates another enlarged side view of a portion of the cellular shade shown in FIG. 2, particularly illustrating an outer cell of the cellular shade formed from a single cell web coupled to adjacent outer cells at first and second junction lines;

FIG. 6 illustrates a partial, front perspective view of another embodiment of a cellular shade having a plurality of vertically arranged outer cells and a plurality of inner cells formed within each outer cell, particularly illustrating the cellular shade in an expanded or extended position;

FIG. 7 illustrates a partial side view of the cellular shade shown in FIG. 6;

FIG. 8 illustrates an enlarged side view of a portion of the cellular shade shown in FIG. 7; and FIG. 9 illustrates a partial side view of another embodiment of a cellular shade having a plurality of vertically arranged outer cells and a plurality of inner cells formed within each outer cell.

DETAILED DESCRIPTION OF THE INVENTION

Figure 1:
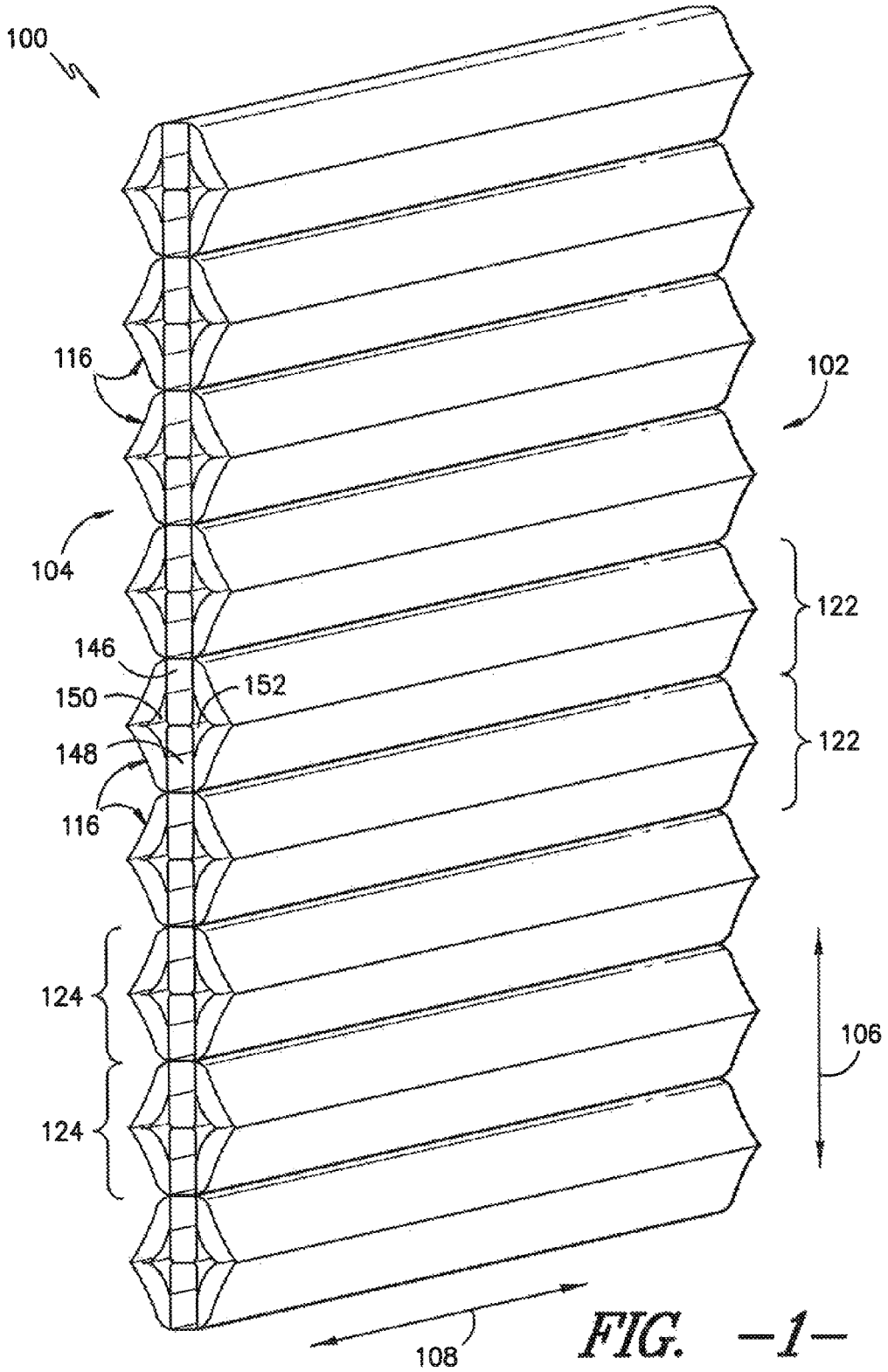
FIG. 1 illustrates a partial, front perspective view of one embodiment of a cellular shade having a plurality of vertically arranged outer cells and a plurality of inner cells formed within each outer cell, particularly illustrating the cellular shade in an expanded or extended position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to an extendable and retractable cellular shade that can be mounted in an architectural opening, such as a window or door, for blocking light, providing privacy, increasing the aesthetic appeal of a room, and/or allowing a desired amount of light into a room. Specifically, in several embodiments, the cellular shade may include a plurality of outer cells stacked vertically one on top of the other, with each outer cell being joined or coupled to adjacent outer cells at first and second junction lines. Each outer cell may generally be formed by one or more cell webs extending between the first and second junction lines so as to define a substantially closed shape. For instance, in one embodiment, a first cell web may be configured to extend between the first and second junction lines along a rear side of each outer cell so as to define a portion of a rear face of the cellular shade and a second cell web may be configured to extend between the first and second junction lines along a front side of each outer cell so as to define a portion of a front face of the cellular shade.

Additionally, one or more inner cells may be formed within each outer cell by coupling one or more inner webs to portions of the cell web(s) forming each outer cell and/or to other inner web(s). For instance, in several embodiments, at least two inner cells, such as a first inner cell and a second inner cell, may be formed within each outer cell. In such embodiments, the inner cells may be arranged in any suitable manner relative to the outer cell within which they are formed and/or relative to one another. For example, the inner cells contained within each outer cell may be configured to be vertically and/or horizontally arranged with respect to one another. Similarly, the inner cells may be spaced apart from one another within each outer cell and/or positioned directly adjacent to one another, such as by coupling separate walls of each outer cell to one another or by configuring the inner cells to share a common wall.

Moreover, in several embodiments, each inner cell may include a plurality of wall segments forming a substantially closed shape that defines an internal cell area of the inner cell (e.g., the cross-sectional area defined by the substantially closed shape formed by the wall segments). As will be described below, in particular embodiments of the present subject matter, the internal cell area defined by each inner cell may be separate from or exclusive of the internal cell area defined by other inner cells contained within the same outer cell.

Further, in several embodiments, two or more of the inner cells defined within each outer cell may be formed from separate inner webs. For instance, in one embodiment, first and second inner cells may be formed within each outer cell, with the first inner cell being formed entirely or substantially entirely from a first inner web and the second inner cell being formed entirely or substantially entirely from a second inner web. The use of such separate inner webs may, for example, allow for various different inner cell configurations and/or arrangements to be provided for the disclosed cellular shade. In addition, the separate inner webs may allow for a unique lighting effect to be provided for the cellular shade. For example, by utilizing inner webs having differing light transmission properties, the inner cells contained within each outer cell may be oriented and/or arranged relative to one another so as to provide a light-banding effect along the vertical or heightwise direction of the cellular shade. Specifically, as will be described below, the differing light transmission properties of the inner webs may allow for a plurality of light transmission bands to be formed along the heightwise direction of the cellular shade, with each light transmission band corresponding to a vertical section of the shade that is configured to allow a different amount of light to pass therethrough as compared to the vertical sections of the shade positioned directly above and/or below such vertical section. As a result, given the vertically stacked arrangement of the outer cells, an alternating or repeating pattern of light transmission bands may be provided along the height of the cellular shade.

It should be appreciated that, as used herein, the term "web" generally refers to any material suitable for use within a cellular shade, including, but not limited to, woven fabrics, non-woven fabrics, knitted fabrics, films, and/or laminations of any such material(s). In addition, the webs may be flexible or semi-rigid. A flexible web is formed from a material that is capable of being folded or flexed, such as woven, knitted, or non-woven fabrics; vinyl or film sheets; cords of natural or synthetic fibers; monofilaments; and the like. A semi-rigid web, on the other hand, is formed from a material that is somewhat stiffer, but is still flexible or foldable to some degree.

It should also be appreciated that the disclosed cellular shade will generally be described herein as having a horizontal shade configuration such that the outer cells extend lengthwise in the horizontal direction and the shade is configured to be extended and retracted in the vertical direction (e.g., using a lift cord or other suitable device). However, one of ordinary skill in the art should readily appreciate that the disclosed cellular shade may also be utilized in a vertical shade configuration such that the outer cells extend lengthwise in the vertical direction and the shade is configured to be extended and retracted in the horizontal direction (e.g., using a vertical blind tract or other suitable device). Thus, when the disclosed cellular shade is used as a vertical shade, it should be appreciated that the directional references used herein may refer to the shade(s) rotated 90 degrees.

Figure 2:
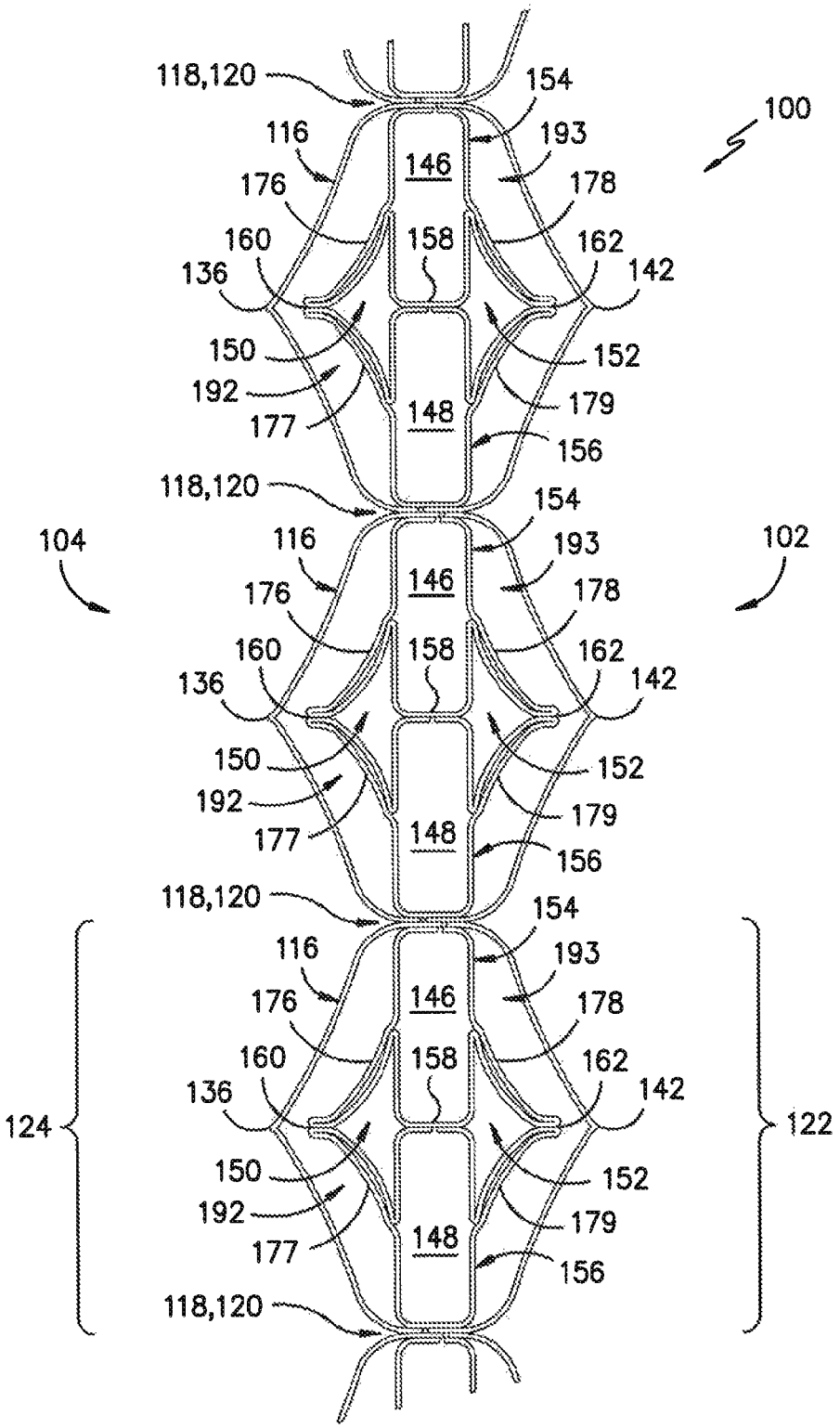
FIG. 2 illustrates a partial side view of the cellular shade shown in FIG. 1.
Figure 3:
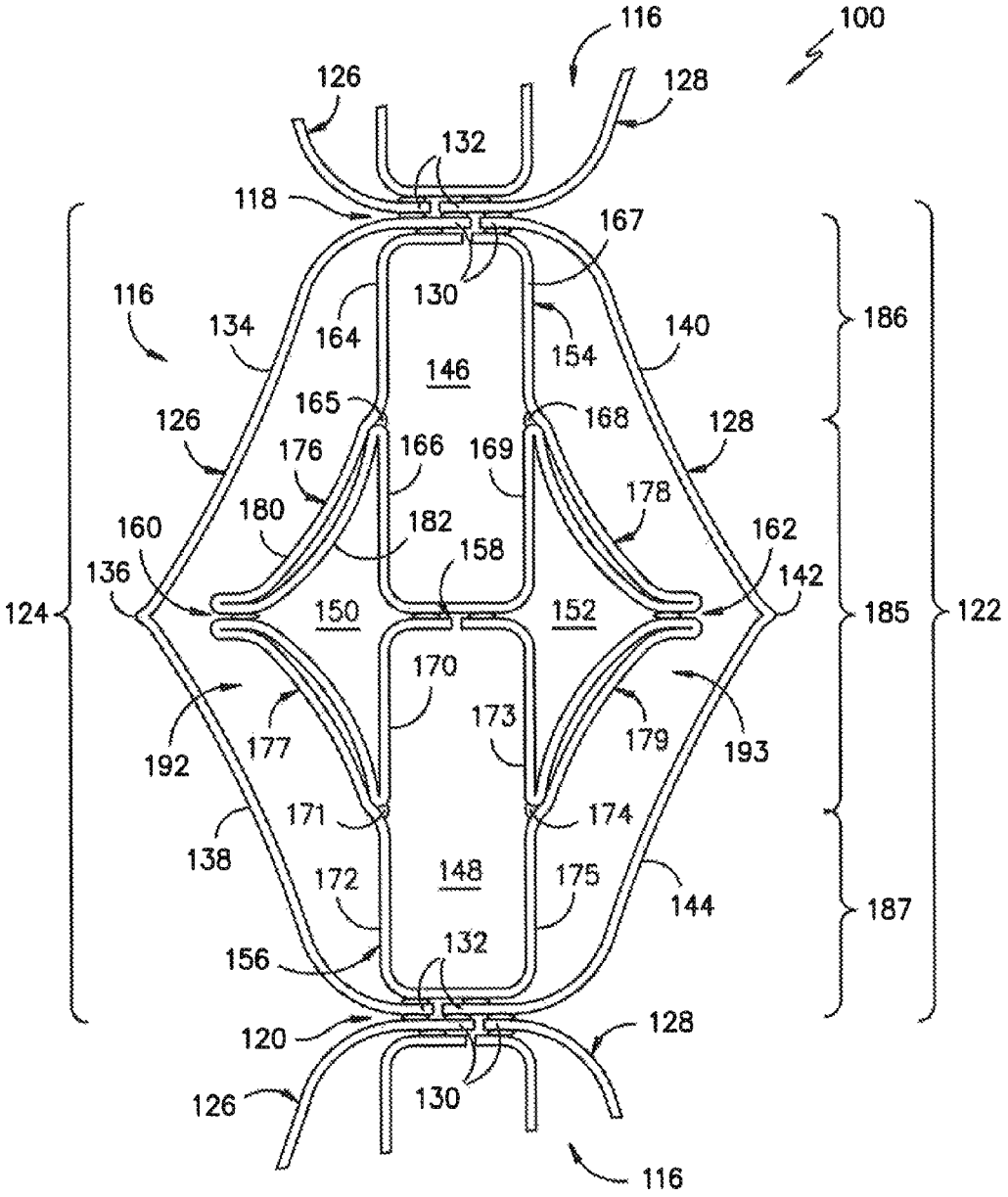
FIG. 3 illustrates an enlarged side view of a portion of the cellular shade shown in FIG. 2, particularly illustrating an outer cell of the cellular shade formed from two separate cell webs coupled to adjacent outer cells at first and second junction lines.
Figure 4:
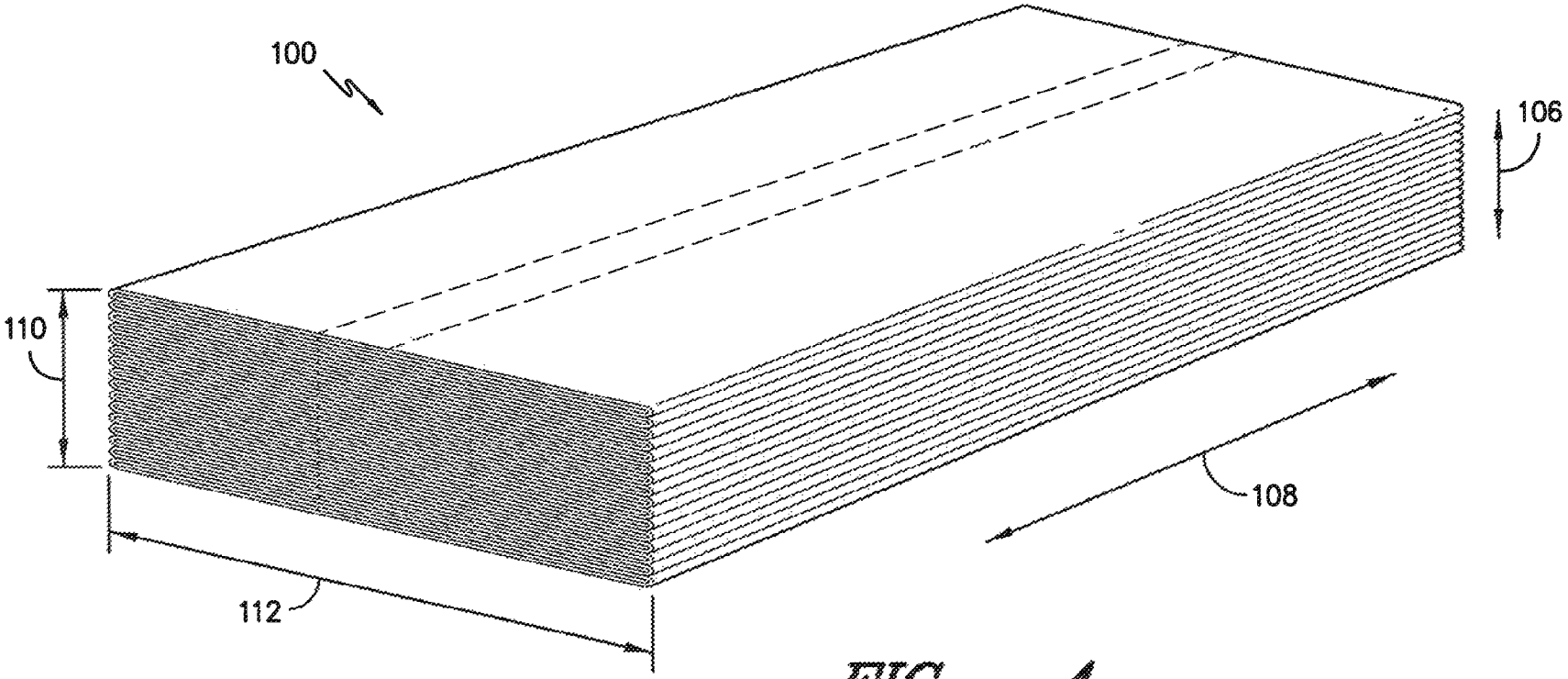
FIG. 4 illustrates another partial, front perspective view of the portion of the cellular shade shown in FIG. 1, particularly illustrating the cellular shade in a retracted position.

Referring now to the drawings, FIGS. 1-4 illustrate several views of one embodiment of a portion of an extendable and retractable cellular shade 100 in accordance with aspects of the present subject matter. Specifically, FIG. 1 illustrates a perspective view of a portion of the cellular shade 100 in an expanded or extended position. FIG. 2 illustrates a partial side view of the cellular shade 100 shown in FIG. 1. FIG. 3 illustrates an enlarged view of a portion of the cellular shade 100 shown in FIG. 2. Additionally, FIG. 4 illustrates a perspective view of the cellular shade 100 shown in FIG. 1 after the shade was moved from the extended position to a retracted position.

It should be appreciated that, in general, the cellular shade 100 may be configured to be mounted within a window or other architectural opening as may be desired. For instance, in one embodiment, the cellular shade 100 may be placed in operative association with a head rail assembly, blind tract assembly, or any other suitable device that is configured to be mounted within an architectural opening. However, it should also be understood that the cellular shade 100 is not limited in its particular use as a window or door shade, and may be used in any application as a covering, partition, shade, or the like in any type of architectural opening in a building or structure.

As shown in the illustrated embodiment, the cellular shade 100 may be movable between an extended position (FIGS. 1-3) and a retracted position (FIG. 4). When extended, the cellular shade 100 may generally define a front face 102 and a rear face 104 configured to extend both in a heightwise direction (indicated by arrow 106 in FIG. 1) a given distance (e.g., any distance along the height of the architectural opening within which the cellular shade 100 is installed) and in a widthwise direction (indicated by arrow 108 in FIG. 1) a given distance (e.g., a distance corresponding to the width of the architectural opening within which the cellular shade 100 is installed). It should be appreciated that the terms "front" and "rear" are generally used herein simply to distinguish opposite sides or faces of the cellular shade 100, itself, and/or to distinguish opposite sides or faces of components or features of the cellular shade 100. Thus, one of ordinary skill in the art should readily appreciate that the front face 102 of the cellular shade 100 may correspond to either the side of the cellular shade 100 designed to face towards the interior of the room within which the shade is installed or the side of the cellular shade 100 designed to face away from the interior of such room. However, for purposes of description, the front face 102 will be described herein as the side of the cellular shade 100 designed to face towards the interior of the room within which the shade is installed.

Additionally, when retracted, the cellular shade 100 may generally be configured to be collapsed into a stack defining a substantially flat profile. For example, as particularly shown in FIG. 4, the stack formed by the collapsed or retracted cellular shade 100 may generally define a substantially constant height 110 extending across a cross-wise dimension 112 of the stacked cellular shade 100. In such an embodiment, the height 110 of the stack may be "substantially constant" if the height at each location along the cross-wise dimension 112 varies by less than about 10%, such as less than about 5%, or less than about 2.5%, or less than about 1%.

It should be appreciated that the cellular shade 100 may include and/or may be associated with any suitable device(s) configured to assist in moving the shade 100 between the extended and retracted positions. For instance, when configured as a horizontal shade, the cellular shade 100 may, in one embodiment, include lift cords (not shown) associated with a rail assembly (not shown) for vertically moving the shade 100 between the extended and retracted positions. In such an embodiment, the lift cords may be configured to extend through the interior of the cellular shade 100. In this manner, the lift cords may be integrated into the product and not left exposed on a surface of the product, thereby providing the cellular shade 100 with a more aesthetically pleasing look. In addition, such hidden or integrated lift cords may also significantly reduce and/or eliminate the child safety risks typically associated with lift cords. Similarly, when configured as a vertical shade, the cellular shade may be configured to be in operative association with a vertical blind tract or any other suitable device for horizontally moving the shade 100 between the extended and retracted positions.

As shown in the illustrated embodiment, the cellular shade 100 may generally include a plurality of vertically arranged outer cells 116 stacked one on top of the other. In general, the outer cells 116 may be configured to have an extended or open cross-sectional configuration when the cellular shade 100 is moved to the extended position (e.g., as shown in FIGS. 1-3) and a retracted or flat cross-sectional configuration when the cellular shade 100 is moved to the retracted position (e.g., as shown in FIG. 4).

As shown in FIGS. 2 and 3, when the cellular shade 100 is extended, each outer cell 116 may generally be configured to define a substantially closed shape or perimeter extending heightwise between a first junction line 118 and a second junction line 120, with the first and second junction lines 118, 120 generally defining boundary lines between each outer cell 116 its adjacent outer cells 116. For instance, as particularly shown in FIG. 3, the first junction line 118 may define a boundary line between a particular outer cell 116 and the outer cell 116 located immediately above such outer cell 116 while the second junction line 120 may define a boundary line between the particular outer cell 116 and the outer cell 116 located immediately below such outer cell 116. Additionally, each outer cell 116 may define a front side 122 and a rear side 124 extending between the first and second junction lines 118, 120. As particularly shown in FIGS. 1 and 2, the front side 122 of each outer cell 116 may generally be configured to define a portion of the front face 102 of the cellular shade 100 while the rear side 124 of each outer cell 116 may generally be configured to define a portion of the rear face 104 of the cellular shade 100.

It should be appreciated that, in several embodiments, each outer cell 116 may be formed by two or more cell webs extending between the first and second junction lines 118, 120 so as to define the substantially closed shape or perimeter of the cell 116. For example, as particularly shown in FIG. 3, each outer cell 116 may be formed by a first cell web 126 configured to extend between the first and second junction lines 118, 120 so as to define the rear side 124 of the outer cell 116 and a second cell web 128 configured to extend between the first and second junction lines 118, 120 so as to define the front side 122 of the outer cell 116. In such an embodiment, the first and second cell webs 126, 128 of each outer cell 116 may be configured to be coupled to the first and second cell webs 126, 128 of adjacent outer cells 116 using an offset attachment configuration. For example, both the first cell web 126 and the second cell web 128 may include a top joint portion 130 defined at the first junction line 118 and a bottom joint portion 132 defined at the second junction line 120. As particularly shown in FIG. 3, the top joint portion 130 of the first cell web 126 may be configured to extend across and/or overlap both the bottom joint portion 132 of the adjacent first cell web 126 and the bottom joint portion 132 of the adjacent second cell web 128, thereby allowing the first cell web 126 to be coupled (e.g., via a suitable adhesive) at the first junction line 118 to both of the cell webs forming the adjacent upper cell 116. In doing so, the top joint portion 130 of the second cell web 128 may only be configured to be coupled to the bottom joint portion 132 of the adjacent second cell web 128 at the first junction line 118. However, as shown in FIG. 3, at the opposite end of the outer cell 116, the bottom joint portion 132 of the second cell web 128 may be configured to extend across and/or overlap both the top joint portion 130 of the adjacent second cell web 128 and the top joint portion 130 of the adjacent first cell web 126, thereby allowing the second cell web 128 to be coupled (e.g., via a suitable adhesive) at the second junction line 120 to both of the cell webs forming the adjacent lower cell 116. In doing so, the bottom joint portion 132 of the first cell web 126 may only be configured to be coupled to the top joint portion 130 of the adjacent first cell web 126 at the second junction line 120.

It should be appreciated that, in other embodiments, the first and second cell webs 126, 128 of each outer cell 116 may be configured to be coupled to one another and/or to the cell webs 126, 128 of adjacent outer cells 116 using any other suitable attachment configuration.

It should also be appreciated that, by forming each outer cell 116 from two separate cell webs, the front face 102 of the cellular shade 100 may be formed from a material that differs from the material used to form the rear face 104 of the cellular shade 100. For example, the cell webs forming the front face 102 (e.g., the second cell webs 128 of FIG. 3) may be made from a material that does not permit significant amounts of light to pass through the material, while the cell webs forming the rear face 104 (e.g., the first cell webs 126 of FIG. 3) may be made from a material that allows much larger quantities of light to pass through the material. In this manner, the front face 102 of the cellular shade 100 may appear to illuminate when the shade 100 is in the extended position and light is striking the shade 100 from the back side. Similarly, when the front face 102 corresponds to the side of the cellular shade 100 facing the interior of the room within which the shade 100 is installed, the cell webs forming the front face 102 may, for example, be formed from a material having an aesthetically pleasing design or texture. In such an embodiment, since the rear face 104 of the cellular shade 100 may not be typically viewed, the cell webs forming the rear face 104 may be formed from a material that is less ornate and, thus, less expensive, thereby reducing the overall cost of manufacturing the cellular shade 100.

Additionally, it should be appreciated that, in alternative embodiments, each outer cell 116 may be formed by a single web extending between the first and second junction lines 118, 120. An example of such a configuration is provided in FIG. 5. As shown, each outer cell 116 includes a single web 127 that is looped between the first and second junction lines 118, 120 so as to define both the front and rear sides 122, 124 of the outer cell 116. Specifically, the looped web 127 may be configured to extend between a first web end 129 and a second web end 131, with the ends 129, 131 of the looped web 127 being coupled to the web 127 of an adjacent outer cell 116 at one of the junction lines (e.g., the first junction line 118). In such an embodiment, the looped web 127 may be coupled to the web 127 of the other adjacent outer cell 116 at a given location between its first and second web ends 129, 131 so as to define the other junction line (e.g., the second junction line 120).

It should also be appreciated that the front and rear sides 122, 124 of each outer cell 116 may each be formed from one or more wall segments forming all or part of the corresponding cell web(s). As used herein, the term "wall segment" generally refers to the portion of a web forming a wall or section of the substantially closed shape defined by a cell that extends along the outer perimeter of the cell between ends formed by a fold or crease line and/or a junction line, joint location, and/or any other attachment line/point/location for the web. For instance, as shown in FIG. 3, the rear side 124 of each outer cell 116 may be formed from a first upper wall segment 134 of the first cell web 126 (or cell web 127) extending between the first junction line 118 and a first outer crease line 136 and a first lower wall segment 138 of the first cell web 126 (or cell web 127) extending between the first outer crease line 136 and the second junction line 120. Similarly, the front side 122 of each outer cell 116 may be formed from a second upper wall segment 140 of the second cell web 128 (or cell web 127) extending between the first junction line 118 and a second outer crease line 142 and a second lower wall segment 144 of the second cell web 128 (or cell web 127) extending between the second outer crease line 142 and the second junction line 120.

Referring still to FIGS. 1-4, in several embodiments, one or more inner cells may be formed within each outer cell 116, with each inner cell defining a substantially closed shape within the perimeter of its corresponding outer cell 116. For instance, as shown in the illustrated embodiment, each outer cell 116 includes four separate inner cells 146, 148, 150, 152, such as a top inner cell 146, a bottom inner cell 148 and first and second side cells 150, 152. However, in alternative embodiments, any other suitable number of inner cells may be formed within each outer cell 116, such as three or fewer inner cells or five or more inner cells. For instance, as will be described below with reference to FIGS. 6-9, the disclosed cellular shade may, in some embodiments, only include two inner cells.

In general, each inner cell 146, 148, 150, 152 may be formed by one or more inner cell webs extending within each corresponding outer cell 116. For example, as shown FIGS. 2 and 3, the various inner cells 146, 148, 150, 152 are formed within each outer cell 116 using first and second inner webs 154, 156 coupled to one another at various locations within the interior of the outer cell 116. Specifically, in several embodiments, the first and second inner webs 154, 156 may be coupled to one another at an intermediate junction line 158 positioned between the first and second junction lines 118, 120 as well as at first and second attachment locations 160, 162 positioned along opposite sides of the intermediate junction line 158. For example, as shown in FIG. 3, the first inner web 154 may be configured to be coupled to the cell web(s) of the outer cell 116 at a location adjacent to the first junction line 118 and may extend downward to the intermediate junction line 158 so as to form the top inner cell 146. Additionally, the second inner web 156 may be configured to be coupled to the cell web(s) of the outer cell 116 at a location adjacent to the second junction line 120 and may extend upward to the intermediate junction line 158 so as to form the bottom inner cell 148. Moreover, the first and second inner webs 154, 156 may also be configured to extend outwardly from the top and bottom inner cells 146, 148 so as to allow such webs 154, 156 to be coupled to one another at the first and second attachment locations 160, 162 in order to form the first and second side cells 150, 152 along each side of the top and bottom inner cells 146, 148.

As shown in FIGS. 2 and 3, due to the arrangement of the inner webs 154, 156, the top inner cell 146 may be formed entirely and/or substantially by the first inner web 154 and the bottom inner cell 148 may be formed entirely and/or substantially by the second inner web 156. Specifically, in several embodiments, the top inner cell 146 may generally define a substantially closed shape having first and second sides formed by the portions of the first inner web 154 extending heightwise between the first junction line 118 and the intermediate junction line 158. For example, as particularly shown in FIG. 3, the first side of the top inner cell 146 may generally be formed by a first upper wall segment 164 of the first inner web 154 extending between the first junction line 118 and a first joint location 165 defined between the first and intermediate junction lines 118, 158 and a first lower wall segment 166 of the first inner web 154 extending between the first joint location 165 and the intermediate junction line 158. Additionally, the second side of the top inner cell 146 may generally be formed by a second upper wall segment 167 of the first inner web 154 extending between the first junction line 118 and a second joint location 168 defined between the first and intermediate junction lines 118, 158 and a second lower wall segment 169 of the first inner web 154 extending between the second joint location 168 and the intermediate junction line 158.

Similarly, in several embodiments, the bottom inner cell 148 may generally define a substantially closed shape having first and second sides formed by the portions of the second inner web 156 extending heightwise between the second junction line 120 and the intermediate junction line 158. For example, as shown in FIG. 3, the first side of the bottom inner cell 148 may generally be formed by a first upper wall segment 170 of the second inner web 156 extending between the intermediate junction line 158 and a first joint location 171 defined between the intermediate and second junction lines 158, 120 and a first lower wall segment 172 of the second inner web 156 extending between the first joint location 171 and the second junction line 120. Additionally, the second side of the bottom inner cell 148 may generally be formed by a second upper wall segment 173 of the second inner web 156 extending between the intermediate junction line 158 and a second joint location 174 defined between the intermediate and second junction lines 158, 120 and a second lower wall segment 175 of the second inner web 156 extending between the second joint location 174 and the second junction line 120.

It should be appreciated that the wall segments forming each of the top and bottom inner cells 146, 148 may collectively define an internal cell area for their corresponding inner cell 146, 148. Specifically, the various wall segments 164, 166, 167, 169 of the top inner cell 146 may generally form a substantially closed shape defining a first internal cell area (e.g., the open area defined within the top inner cell 146 that extends vertically between the first and intermediate junction lines 118, 158 and horizontally between the first and second sides of the top inner cell 146). Similarly, the various wall segments 170, 172, 173, 175 of the bottom inner cell 148 may generally form a substantially closed shape defining a second internal cell area (e.g., the open area defined within the bottom inner cell 148 that extends vertically between the intermediate and second junction lines 158, 120 and horizontally between the first and second sides of the bottom inner cell 148). As particularly shown in FIG. 3, the first internal cell area defined by the wall segments 164, 166, 167, 169 of the top inner cell 146 may, in several embodiments, be exclusive of the second internal cell area defined by the wall segments 170, 172, 173, 175 of the bottom inner cell 148 and vice versa. As such, neither inner cell incorporates or encompasses any portion of the internal cell area of the other inner cell.

As shown in the illustrated embodiment, the top and bottom inner cells 146, 148 generally define substantially rectangular shapes when the cellular shade 100 is in the extended position. However, in other embodiments, the arrangement of the inner webs 154, 156 may be adjusted such that the top and bottom inner cells 146, 148 define any other suitable shape, such as a hexagon shape.

Moreover, in several embodiments, the first and second side cells 150, 152 may each be formed directly between the first and second inner webs 154, 156 along each side of the top and bottom inner cells 146, 148. Specifically, the first side cell 150 may generally define a substantially closed shape having an inner side shared with portions of the top and bottom inner cells 146, 148 and an outer side extending outwardly from the top and bottom inner cells 146, 148 towards the rear side 124 of each outer cell 116. For example, as shown in FIG. 3, the inner side of the first side cell 150 may generally be formed by the first lower wall segment 166 of the first inner web 154 and the first upper wall segment 170 of the second inner web 156. As such, the first lower wall segment 166 of the first inner web 154 may form a common wall segment between the first side cell 150 and the top inner cell 146 and the first upper wall segment 170 of the second inner web 156 may form a common wall segment between the first side cell 150 and the bottom inner cell 148. Additionally, the outer side of the first side cell 150 may generally be formed by overlapping side portions 176, 177 of the first and second inner webs 154, 156. Specifically, a first overlapped side portion 176 of the first inner web 154 may be configured to extend between the first joint location 165 for the top inner cell 146 and the first attachment location 160 and a first overlapped side portion 177 of the second inner web 156 may be configured to extend between the first attachment location 160 and the first joint location 171 for the bottom inner cell 148, with such overlapped side portions 176, 177 being coupled to one another at the first attachment location 160.

Similarly, the second side cell 152 may generally define a substantially closed shape having an inner side shared with portions of the top and bottom inner cells 146, 148 and an outer side extending outwardly from the top and bottom inner cells 146, 148 towards the front side 122 of each outer cell 116. For example, as shown in FIG. 3, the inner side of the second side cell 152 may generally be formed by the second lower wall segment 169 of the first inner web 154 and the second upper wall segment 173 of the second inner web 154. As such, the second lower wall segment 169 of the first inner web 154 may form a common wall segment between the second side cell 152 and the top inner cell 146 and the second upper wall segment 173 of the second inner web 154 may form a common wall segment between the second side cell 152 and the bottom inner cell 148. Additionally, the outer side of the second side cell 152 may generally be formed by overlapping side portions 178, 179 of the first and second inner webs 154, 156. Specifically, a second overlapped side portion 178 of the first inner web 154 may be configured to extend between the second joint location 168 for the top inner cell 146 and the second attachment location 162 and a second overlapped side portion 179 of the second inner web 156 may be configured to extend between the second attachment location 162 and the second joint location 174 for the bottom inner cell 148, with such overlapped side portions 178, 179 being coupled to one another at the second attachment location 162.

It should be appreciated that side portions 176, 177, 178, 179 of the inner webs 154, 156 may generally be formed by overlapping the portions of such webs 154, 156 extending between the adjacent upper and lower wall segments along each side of the top and bottom inner cells 146, 148. For example, as shown in FIG. 3, along the first side of the top inner cell 146, the first overlapped portion 176 of the first inner web 154 may be formed by overlapping the section of the inner web 154 extending between the first upper wall segment 164 and the first lower wall segment 166 such that the first overlapped portion 176 includes both an upper overlapped wall segment 180 extending from the first upper wall segment 164 (e.g., at the first joint location 165) to the first attachment location 160 and a lower overlapped wall segment 182 extending from the first attachment location 160 to the first lower wall segment 166 (e.g., at the first joint location 165). In such an embodiment, the upper and lower overlapped wall segments 180, 182 may be coupled to one another at the first joint location 165 (e.g., using a suitable adhesive) in order to maintain the desired shape of the top inner cell 146. Additionally, although not shown, the upper and lower overlapped wall segments 180, 182 may also be coupled to one another at the first attachment location 160 (e.g., using a suitable adhesive). Of course, the various other overlapped side portions 177, 178, 179 may be configured similar to that described above, with each including upper and lower overlapped wall segments.

It should also be appreciated that, similar to the top and bottom inner cells 146, 148 described above, the wall segments forming each of the first and second side cells 150, 152 may collectively define an internal cell area for each side cell. Specifically, the various wall segments 166, 170, 176, 177 of the first side cell 150 may generally form a substantially closed shape defining a third internal cell area (e.g., the open area defined within the first side cell 150 that extends between its inner and outer sides). Similarly, the various wall segments 169, 173, 178, 179 of the second side cell 152 may generally form a substantially closed shape defining a fourth internal cell area (e.g., the open area defined within the second side cell 152 that extends between its inner and outer sides). As particularly shown in FIG. 3, the third internal cell area defined by the wall segments 166, 170, 176, 177 of the first side cell 150 may, in several embodiments, be exclusive of the fourth internal cell area defined by the wall segments 169, 173, 178, 179 of the second side cell 152 and vice versa. As such, neither side cell incorporates or encompasses any portion of the internal cell area of the other side cell. Moreover, as shown in FIG. 3, the internal cell area defined by each side cell 150, 152 may also be exclusive of the internal cell area defined by each inner cell 146, 148.

Additionally, it should be appreciated that the first and second side cells 150, 152 may generally be configured to define any suitable shape when the cellular shade 100 is in the extended position. For example, as shown in the illustrated embodiment, the first and second side cells 150, 152 generally define substantially triangular or pyramidal shapes. However, in other embodiments, the arrangement of the inner webs 154, 156 may be adjusted such that the first and second side cells 150, 152 define any other suitable shape, such as a diamond shape.

As shown in FIGS. 2 and 3, due to the configuration of the disclosed cellular shade 100, the first and second side cells 150, 152 are spaced apart from the rear and front sides 124, 122 of each outer cell 116, respectively. Specifically, a first side gap 192 may be defined between the rear side 124 of each outer cell 116 and each first side cell 150 and a second side gap 193 may be defined between the front side 122 of each outer cell 116 and each second side cell 152. As shown in the illustrated embodiment, the first and second side gaps 192, 193 are substantially chevron-shaped. However, in other embodiments, the first and second side gaps 192, 193 may define any other suitable shape depending on the overall shape of each outer cell 116 and/or the shape(s) of the various inner cells 146, 148, 150, 152.

Additionally, in several embodiments, the first and second attachment locations 160, 162 may be configured to be vertically aligned with the first and second outer crease lines 136, 142 of each corresponding outer cell 116 and/or with the intermediate junction line 158 defined within each outer cell 116. For example, as shown in FIG. 3, the first and second attachment locations 160, 162 are vertically aligned with both the outer crease lines 136, 142 and the intermediate junction line 158. Such alignment of the attachment locations 160, 162 with the outer crease lines 136, 142 and/or the intermediate junction line 158 may facilitate adjusting the cellular shade 100 from its extended position to its retracted position. For instance, such vertical alignment may facilitate stacking the cellular shade 100 in the manner shown in FIG. 4.

It should be appreciated that the amount of light that is transmitted through the disclosed cellular shade 100 may generally vary depending upon the material(s) used to form each outer cell 116 (e.g., the material(s) used to form the cell web(s) 126, 128) and/or the material(s) used to form the various inner cells 146, 148, 150, 152 (e.g., the material(s) used to form the inner web(s) 154, 156). For example, by selecting webs having significantly low light transmittance values (i.e., the ratio of the amount of light that is allowed to pass through a web to the amount of total light hitting or striking the web) such that all or substantially all of the light hitting the cellular shade 100 is prevented from passing therethrough, the shade 100 may be used as a blackout shade. Alternatively, the web(s) may be selected such that a small portion or a substantial portion of the light hitting the cellular shade 100 is allowed to pass through the shade 100. In doing so, given the configuration of the cellular shade 100 shown in FIGS. 1-4, the amount of light passing through different vertical sections of each outer cell 116 may vary, thereby providing a unique illumination design/effect for the shade 100. For example, due to the significant amount of web material included within a middle section of each outer cell 116 (e.g., as indicated by bracket 185), less light may be transmitted through such middle section 185 than the vertical sections positioned directly above and below the middle section 185 (indicated by brackets 186, 187). As such, when viewing the front face 102 of the cellular shade 100 as light is hitting the rear face 104, the portions of the front face 102 aligned with the upper and lower vertical sections 186, 187 of each outer cell 116 may appear significantly more illuminated than the portions of the front face 102 aligned with the middle section 185 of each outer cell 116. This may create a light-banding effect along the heightwise direction of the cellular shade 100, with the shade 100 including a plurality of light transmission bands formed along its height.

For instance, in one embodiment, each vertical section 185, 186, 187 may correspond to a different light transmission band that allows for differing amounts of light to be passed through each outer cell 116. In such an embodiment, when viewing the front face 102 of the cellular shade 100 as light is hitting the rear face 104, the shade 100 may appear to have a repeating pattern of three distinct light transmission bands along its height. Alternatively, the upper and lower vertical sections 186, 187 may be configured to allow the same amount of light to pass through each outer cell 116 while the middle section 185 may allow a different amount of light to pass therethrough. In such an embodiment, when viewing the front face 102 of the cellular shade 100 as light is hitting the rear face 104, the shade 100 may appear to have an alternating pattern of lower and higher light transmission bands along its height.

Referring now to FIGS. 6-8, another embodiment of a cellular shade 200 is illustrated in accordance with aspects of the present subject matter. Specifically, FIG. 6 illustrates a perspective view of a portion of the cellular shade 200 in an expanded or extended position. FIG. 7 illustrates a partial side view of the cellular shade 200 shown in FIG. 6. Additionally, FIG. 8 illustrates an enlarged view of a portion of the cellular shade 200 shown in FIG. 7.

In general, the cellular shade 200 may be configured similar to the cellular shade 100 described above. For example, the shade 200 may include a plurality of vertically arranged outer cells 216, with each outer cell 216 being coupled to adjacent outer cells 216 at a first junction line 218 and a second junction line 220. In addition, each outer cell 216 may include a front side 222 defining a portion of a front face 202 of the cellular shade 200 and a rear side 224 defining a portion of a rear face 204 of the cellular shade 200, with each side 222, 224 being formed from a separate cell web (e.g., as shown in FIG. 8) or from a single looped web (e.g., similar to that shown in FIG. 5).

Moreover, the front and rear sides 222, 224 of each outer cell 216 may generally be defined by one or more wall segments of the corresponding cell web(s) extending between the first and second junction lines 218, 220. For instance, as shown in FIG. 8, the rear side 224 of each outer cell 216 may be formed from a first upper wall segment 234 extending between the first junction line 218 and a first outer crease line 236 and a first lower wall segment 238 extending between the first outer crease line 236 and the second junction line 220. Similarly, the front side 222 of each outer cell 216 may be formed from a second upper wall segment 240 extending between the first junction line 218 and a second outer crease line 242 and a second lower wall segment 244 extending between the second outer crease line 242 and the second junction line 220.

Additionally, in several embodiments, one or more inner cells may be formed within each outer cell 216, with each inner cell defining a substantially closed shape within the inner perimeter of its corresponding outer cell 216. For instance, as shown in the illustrated embodiment, each outer cell 216 includes first and second inner cells 250, 252 spaced apart from one another within the interior of the outer cell 216. However, in other embodiments, the cellular shade 200 may be configured to include three or more inner cells spaced apart from one another within each outer cell 216 or the cellular shade 200 may only include a single inner cell contained within each outer cell 216.

In general, each inner cell 250, 252 may be formed from one or more inner webs attached to one or more locations around and/or within the inner perimeter of each outer cell 216 so that the inner cell 250, 252 defines a substantially closed shape. For example, as shown in FIG. 8, the first inner cell 250 is formed from a first inner web 254 having a looped configuration such that first and second ends 290, 291 of the first inner web 254 are positioned directly adjacent to one another so as to define the substantially closed shape of the inner cell 250. Similarly, the second inner cell 252 is formed from a second inner web 256 having a looped configuration such that first and second ends 292, 293 of the second inner web 256 are positioned directly adjacent to one another so as to define the substantially closed shape of the inner cell 252. It should be appreciated that, in other embodiments, the substantially closed shape defined by each inner cell 250, 252 may be achieved without using the looped or end-to-end configuration shown in the illustrated embodiment. For instance, in an alternative embodiment, the ends of the inner webs 254, 256 may be coupled to the outer cell 216 such that the each inner cell 250, 252 is defined by both its corresponding inner web 254, 256 and a portion of the cell web(s) forming the corresponding outer cell 216.

As particularly shown in FIG. 8, in several embodiments, the first and second inner cells 250, 252 may each be configured to be coupled to opposite sides of each outer cell 216 at first and second attachment locations 260, 261, 262, 263. For example, each first inner cell 250 may be coupled along the rear side 224 of each outer cell 216 at a first attachment location 260 defined on the first upper wall segment 234 of the outer cell 216 and at a second attachment location 261 defined on the first lower wall segment 238 of the outer cell 216 so that the first outer crease line 236 is positioned between such first and second attachment locations 260, 261. Similarly, as shown in FIG. 8, each second inner cell 252 may be coupled along the front side 222 of each outer cell 216 at a first attachment location 262 defined on the second upper wall segment 240 of the outer cell 216 and at a second attachment location 263 defined on the second lower wall segment 244 of the outer cell so that the second outer crease line 242 is positioned between such first and second attachment locations 262, 263. However, it should be appreciated that, in alternative embodiments, the first and second inner cells 250, 252 may be configured to be coupled to each outer cell 216 at one or more attachment locations defined at any other suitable locations around the inner perimeter of each cell 216.

In several embodiments, each inner cell 250, 252 may be configured to define a triangular or pyramidal shape when the cellular shade 200 is in the extended position. For example, as shown in the illustrated embodiment, each inner cell 250, 252 includes an outer side having first and second angled wall segments 264, 265 extending outwardly from the first and second attachment locations, respectively, to a first inner crease line 266 and an inner side having first and second inner wall segments 267, 268 extending substantially vertically from the first and second attachment locations, respectively, to a second inner crease line 269 so as to form the illustrated triangular shape. However, in other embodiments, each inner cell 250, 252 may be configured to define any other suitable shape, such as diamond shape.

It should be appreciated that, similar to the embodiment described above, the wall segments forming each of the first and second inner cells 250, 252 may collectively define an internal cell area for each inner cell. Specifically, the various wall segments 264, 265, 267, 268 of the first inner cell 250 may generally form a substantially closed shape defining a first internal cell area (e.g., the open area defined within the first inner cell 150 between its inner and outer sides). Similarly, the various wall segments 264, 265, 267, 268 of the second inner cell 252 may generally form a substantially closed shape defining a second internal cell area (e.g., the open area defined within the second inner cell 252 between its inner and outer sides). As particularly shown in FIG. 8, the first internal cell area defined by the wall segments 264, 265, 267, 268 of the first inner cell 250 may, in several embodiments, be exclusive of the second internal cell area defined by the wall segments 264, 265, 267, 268 of the second inner cell 252 and vice versa. As such, neither inner cell incorporates or encompasses portions of the internal cell area of the other inner cell.

Additionally, in several embodiments, the first inner crease line 266 and/or the second inner crease line 269 defined by each inner cell 250, 252 may be configured to be vertically aligned with the outer crease lines 236, 242 of each corresponding outer cell 216. For example, as shown in FIG. 8, the first and second inner crease lines 266, 269 for the inner cells 250, 252 are both vertically aligned with the outer crease lines 236, 242 of the illustrated outer cell 216. Such alignment of the various crease lines may assist in adjusting the cellular shade 200 from its extended position to its retracted position. For instance, the aligned crease lines may facilitate stacking the cellular shade 200 in a manner similar to that shown in FIG. 4.

Moreover, due to the configuration of the disclosed cellular shade 200, portions of the first and second inner cells 250, 252 may be spaced apart from the rear and front sides 222, 224 of each outer cell 216, respectively. Specifically, as shown in FIG. 8, a first side gap 282 may be defined between the rear side 224 of each outer cell 216 and each first side cell 250 and a second side gap 283 may be defined between the front side 222 of each outer cell 216 and each second side cell 252. As shown in the illustrated embodiment, the first and second side gaps 282, 283 are substantially chevron-shaped. However, in other embodiments, the first and second side gaps 282, 283 may define any other suitable shape depending on the overall shape of each outer cell 216 and/or the shape(s) of the inner cells 250, 252.

Additionally, as indicated above, the first and second inner cells 250, 252 may also be configured to be spaced apart from another within each outer cell 216. Thus, as shown in FIG. 8, a central gap 284 may be defined directly between the first and second inner cells 250, 252. In several embodiments, the central gap 284 may be configured to define a substantially rectangular shape. However, in other embodiments, the central gap 284 may define any other suitable shape depending on the overall shape of each outer cell 216 and/or the shape(s) of the inner cells 250, 252.

It should be appreciated that, given the configuration of the front and rear sides 222, 224 of the outer cells 216 as well as the attachment locations 260, 261, 262, 263 for the inner cells 250, 252, each outer cell 216 of the cellular shade 200 may generally define a unique shape. For instance, as shown in FIG. 8, upper and lower vertical sections of each outer cell 216 (indicated by brackets 286, 287) may generally define substantially rectangular shapes while a middle section of each outer cell 216 (indicated by bracket 285) may include triangular shaped portions extending from the attachment locations 260, 261, 262, 263.

It should also be appreciated that, similar to the cellular shade 100 described above, the amount of light that is transmitted through the cellular shade 200 may generally vary depending upon the web(s) used to form the outer cells 216 and/or the web(s) used to form the inner cells 250, 252. For example, by selecting webs having significantly low light transmittance values such that all or substantially all of the light hitting the cellular shade 200 is prevented from passing therethrough, the shade 200 may be used as a blackout shade. Alternatively, the web(s) may be selected such that a small portion or a substantial portion of the light hitting the cellular shade 200 is allowed to pass through the shade 200. In doing so, given the configuration of the illustrated cellular shade 200, the amount of light passing through the different vertical sections 285, 286, 287 of each outer cell 216 may vary, thereby providing a unique illumination design/effect for the shade 200. For example, due to the significant amount of web material included within the middle section 285 of each outer cell 216, less light may be transmitted through such middle section 285 as opposed to the upper and lower vertical sections 286, 287. As such, when viewing the front face 202 of the cellular shade 200 as light is hitting the rear face 204, the portions of the front face 202 aligned with the upper and lower vertical sections 286, 287 of each outer cell 216 may appear significantly more illuminated than the portions of the front face 202 aligned with the middle section 285 of each outer cell 216. This may create a light-banding effect along the heightwise direction of the cellular shade 200, with the shade 200 including a plurality of light transmission bands formed along its height.

For instance, in one embodiment, each vertical section 285, 286, 287 may correspond to a different light transmission band that allows for differing amounts of light to be passed through each outer cell 216. In such an embodiment, when viewing the front face 202 of the cellular shade 200 as light is hitting the rear face 204, the shade 200 may appear to have a repeating pattern of three distinct light transmission bands along its height. Alternatively, the upper and lower vertical sections 286, 287 may be configured to allow the same amount of light to pass through each outer cell 216 while the middle section 285 may allow a different amount of light to pass therethrough. In such an embodiment, when viewing the front face 202 of the cellular shade 200 as light is hitting the rear face 204, the shade 200 may appear to have an alternating pattern of lower and higher light transmission bands along its height.

Referring now to FIG. 9, a side view of another embodiment of a cellular shade 300 is illustrated in accordance with aspects of the present subject matter. Specifically, the cellular shade 300 shown in FIG. 9 provides for a variation of the inner cell configuration of the cellular shade 100 described above with reference to FIGS. 1-5.

As shown in FIG. 9, the shade 300 may include a plurality of vertically arranged outer cells 316, with each outer cell 316 being coupled to adjacent outer cells 316 at a first junction line 318 and a second junction line 320. In addition, each outer cell 316 may include a front side 322 defining a portion of a front face of the cellular shade 300 and a rear side 324 defining a portion of a rear face of the cellular shade 300, with each side 322, 324 being formed from a separate cell web (e.g., as shown in FIG. 9 by using both a first cell web 326 and a second cell web 328) or from a single looped web (e.g., similar to that shown in FIG. 5).

Moreover, the front and rear sides 322, 324 of each outer cell 316 may generally be defined by one or more wall segments of the corresponding cell web(s) extending between the first and second junction lines 318, 320. For instance, as shown in FIG. 9, the rear side 324 of each outer cell 316 may be formed from a first upper wall segment 334 extending between the first junction line 318 and a first outer crease line 336 and a first lower wall segment 338 extending between the first outer crease line 336 and the second junction line 320. Similarly, the front side 322 of each outer cell 316 may be formed from a second upper wall segment 340 extending between the first junction line 318 and a second outer crease line 342 and a second lower wall segment 344 extending between the second outer crease line 342 and the second junction line 320.

Additionally, in several embodiments, one or more inner cells may be formed within each outer cell 316, with each inner cell defining a substantially closed shape within the inner perimeter of its corresponding outer cell 316. For instance, in the illustrated embodiment, each outer cell 316 includes first and second inner cells 346, 348 vertically arranged with respect to one another between the first and second junction lines 318, 320. However, in other embodiments, the cellular shade 300 may be configured to include any other suitable number of inner cells and/or may include inner cells having any other suitable arrangement relative to one another.

In general, each inner cell 346, 348 may be formed from one or more inner webs attached to one or more locations around the inner perimeter of each outer cell 316 and/or to another inner web(s) so that the inner cell 346, 348 defines a substantially closed shape. For example as shown in FIG. 9, the first inner cell 346 is formed from a first inner web 354 having a looped configuration such that first and second ends 394, 395 of the first inner web 354 are positioned directly adjacent to one another so as to define a substantially closed shape, with the ends 394, 395 being coupled to the outer cell 316 at or adjacent to the first junction line 318. Similarly, the second inner cell 348 is formed from a second inner web 356 having a looped configuration such that first and second ends 396, 397 of the second inner web 356 are positioned directly adjacent to one another so as to define a substantially closed shape, with the ends 396, 397 being coupled to the first inner web 354 at or adjacent to an intermediate junction line 358 defined between the first and second inner cells 346, 348. It should be appreciated that, in other embodiments, the substantially closed shape defined by each inner cell 346, 348 may be achieved without using the looped or end-to-end configuration shown in the illustrated embodiment. For instance, in alternative embodiment, the ends of the inner webs 354, 356 may be coupled to the outer cell 316 such that the each inner cell 346, 348 is defined by both its corresponding inner web 354, 356 and a portion of the cell web(s) forming the corresponding outer cell 316.

As shown in FIG. 9, the inner webs 354, 356 forming the inner cells 346, 348 may be coupled to one another at the intermediate junction line 358 positioned between the first and second junction lines 318, 320. In such an embodiment, the first inner cell 346 may generally have first and second sides formed by the portions of the first inner web 354 extending heightwise between the first junction line 318 and the intermediate junction line 358. For example, as particularly shown in FIG. 9, the first side of the first inner cell 346 may generally be formed by a first upper wall segment 364 of the first inner web 354 extending between the first junction line 318 and a first crease line 365 defined between the first and intermediate junction lines 318, 358 and a first lower wall segment 366 of the first inner web 354 extending between the first crease line 365 and the intermediate junction line 358. Additionally, the second side of the first inner cell 346 may generally be formed by a second upper wall segment 367 of the first inner web 354 extending between the first junction line 318 and a second crease line 368 defined between the first and intermediate junction lines 318, 358 and a second lower wall segment 369 of the first inner web 354 extending between the second crease line 368 and the intermediate junction line 358.

Similarly, in the illustrated embodiment, the second inner cell 348 may include first and second sides formed by the portions of the second inner web 356 extending heightwise between the second junction line 320 and the intermediate junction line 358. For example, as shown in FIG. 9, the first side of the second inner cell 348 may generally be formed by a first upper wall segment 370 of the second inner web 356 extending between the intermediate junction line 358 and a first crease line 371 defined between the intermediate and second junction lines 358, 320 and a first lower wall segment 372 of the second inner web 356 extending between the first crease line 371 and the second junction line 320. Additionally, the second side of the second inner cell 348 may generally be formed by a second upper wall segment 373 of the second inner web 356 extending between the intermediate junction line 358 and a second crease line 374 defined between the intermediate and second junction lines 358, 320 and a second lower wall segment 375 of the second inner web 356 extending between the second crease line 374 and the second junction line 320.

It should be appreciated that the wall segments forming each of the first and second inner cells 346, 348 may collectively define an internal cell area for each inner cell. Specifically, the various wall segments 364, 366, 367, 368 of the first inner cell 346 may generally form a substantially closed shape defining a first internal cell area (e.g., the open area defined within the first inner cell 346 that extends vertically between the first and intermediate junction lines 318, 358 and horizontally between the first and second sides f the first inner cell 346). Similarly, the various wall segments 370, 372, 373, 375 of the second inner cell 348 may generally form a substantially closed shape defining a second internal cell area (e.g., the open area defined within the second inner cell 348 that extends vertically between the intermediate and second junction lines 358, 320 and horizontally between the first and second sides of the second inner cell 348). As particularly shown in FIG. 9, the first internal cell area defined by the wall segments 364, 366, 367, 368 of the first inner cell 346 may, in several embodiments, be exclusive of the second internal cell area defined by the wall segments 370, 372, 373, 375 of the second inner cell 348 and vice versa. As such, neither inner cell incorporates or encompasses portions of the internal cell area of the other inner cell.

As shown in the illustrated embodiment, the first and second inner cells 346, 348 generally define substantially rectangular shapes when the cellular shade 300 is in the extended position. However, in other embodiments, the arrangement of the inner webs 354, 356 may be adjusted such that the first and second inner cells 346, 348 define any other suitable shape, such as a hexagon shape.

Additionally, as shown in FIG. 9, due to the configuration of the disclosed cellular shade 300, the first and second inner cells 346, 348 are spaced apart from the front and rear sides 322, 324 of each outer cell 316. Specifically, a first side gap 392 may be defined between the rear side 324 of each outer cell 316 and the inner cells 346, 348 and a second side gap 393 may be defined between the front side 322 of each outer cell 316 and the inner cells 346, 348. As shown in the illustrated embodiment, the first and second side gaps 392, 393 are generally triangular or pyramidal shaped. However, in other embodiments, the first and second side gaps 392, 393 may define any other suitable shape depending on the overall shape of each outer cell 316 and/or the shape(s) of the inner cells 346, 348.

It should be appreciated that the amount of light that is transmitted through the disclosed cellular shade 300 may generally vary depending upon the material(s) used to form each outer cell 316 and/or the material(s) used to form the inner cells 346, 348, (e.g., the material(s) used to form the inner web(s) 354, 356). For example, by selecting webs having significantly low light transmittance values such that all or substantially all of the light hitting the cellular shade 130 is prevented from passing therethrough, the shade 300 may be used as a blackout shade. Alternatively, the web(s) may be selected such that a small portion or a substantial portion of the light hitting the cellular shade 300 is allowed to pass through the shade 300. In doing so, by forming the inner cells 346, 348 from webs having differing light transmission properties, the amount of light passing through different vertical sections of each outer cell 316 may vary, thereby providing a unique illumination design/effect for the shade 300. For example, as shown in FIG. 9, each outer cell 316 may include an upper vertical section generally aligned horizontally with the first inner cell 346 (e.g., as indicated by bracket 386) and a lower vertical section generally aligned horizontally with the second inner cell 348 (e.g., as indicated by bracket 387). Thus, by using inner webs having different light transmission properties, more or less light may be transmitted through the upper vertical section 386 than the lower vertical section 387. As such, when viewing the front face of the cellular shade 300 as light is hitting its rear face, the portions of the front face aligned with the upper vertical section 386 of each outer cell 316 may appear significantly more or less illuminated than the portions of the front face aligned with the lower vertical section 387 of each outer cell 316. This may create a light-banding effect along the heightwise direction of the cellular shade 300 such that the shade 300 includes a plurality of light transmission bands formed along its height. Specifically, each vertical section 386, 387 may correspond to a different light transmission band that allows for differing amounts of light to be passed through each outer cell 316, thereby making the shade 300 appear to have an alternating pattern of lower and higher light transmission bands along its height.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cellular shade for an architectural opening, the cellular shade movable between an extended position and a retracted position, the cellular shade comprising:

a plurality of outer cells arranged vertically with respect to one another, each outer cell of said plurality of outer cells including a first side and a second side extending between a first junction line and a second junction line; and at least two inner cells defined within each said outer cell between said first and second junction lines, said at least two inner cells comprising a first inner cell and a second inner cell, said first inner cell formed from a single continuous first inner web forming a substantially closed shape defining a first internal cell area, said second inner cell formed from a single continuous second inner web forming a substantially closed shape defining a second internal cell area, wherein said first and second internal cell areas are substantially exclusive of one another.

2. The cellular shade of claim 1, wherein said first and second inner cells are arranged vertically with respect to one another within each said outer cell.

3. The cellular shade of claim 2, wherein said first and second inner cells are vertically arranged directly between said first and second junction lines.

4. The cellular shade of claim 1, wherein said first and second inner cells are arranged horizontally with respect to one another within each said outer cell.

5. The cellular shade of claim 1, wherein said first and second inner cells are spaced apart from one another within each said outer cell.

6. The cellular shade of claim 1, wherein said first inner web is couple said first side of each said outer cell and said second inner web is coupled to said second side of each said outer cell.

7. The cellular shade of claim 1, wherein said first and second inner webs are coupled to one another at a junction line positioned between said first and second junction lines.

8. The cellular shade of claim 7, wherein said first and second inner webs are further coupled to one another at first and second attachment locations such that first and second side cells are defined within each said outer cell.

9. The cellular shade of claim 1, wherein:

said first inner cell includes a first plurality of wall segments forming the substantially closed shape defining said first internal area;

said second inner cell includes a second plurality of wall segments forming the substantially closed shape defining said second internal area; and none of said first and second plurality of wall segments define a common wall segment between said first and second inner cells.

10. The cellular shade of claim 1, wherein said first and second inner webs have differing light transmission properties such that an amount of light configured to pass through said first inner cell differs from an amount of light configured to pass through said second inner cell.

11. The cellular shade of claim 10, wherein said first and second inner cells are oriented relative to one another within each said outer cell such that differing light transmission bands are formed along a heightwise direction of the cellular shade as light passes therethrough.

12. The cellular shade of claim 1, wherein:

said first junction line is aligned along a single plane defined between each outer cell and a first adjacent outer cell of said plurality of outer cells; and said second junction line is aligned along a single plane defined between each outer cell and a second adjacent outer cell of said plurality of outer cells.

13. The cellular shade of claim 1, wherein each outer cell is formed from a single continuous outer web.

14. A cellular shade for an architectural opening, the cellular shade movable between an extended position and a retracted position, the cellular shade comprising:

a plurality of outer cells arranged vertically with respect to one another, each outer cell of said plurality of outer cells including a first side and a second side extending in a heightwise direction of the cellular shade between a first junction line and a second junction line, said first side defining a portion of a first outer face of the cellular shade and said second side defining a portion of a second outer face of the cellular shade; and at least two inner cells defined within each said outer cell between said first and second junction lines, said at least two inner cells comprising a first inner cell and a second inner cell, said first inner cell being formed from a first inner web forming a substantially closed shape defining a first internal cell area, said second inner cell being formed from a second inner web forming a substantially closed shape defining a second internal cell area, said first and second internal cell areas being substantially exclusive of one another, said first and second inner webs being coupled to each other at attachment locations along sides of said first and second inner cells form first and second side cells Within each outer cell, said first and second side wherein:

said first and second inner cells are arranged with respect to one another in the heightwise direction of the cellular shade;

a first side gap is defined between said first side of each outer cell and said first and second inner cells that extends in the heightwise direction from said first junction line to said second junction line; and a second side gap is defined between said second side of each outer cell and said first and second inner cells that extends in the heightwise direction from said first junction line to said second junction line.

15. The cellular shade of claim 14, wherein said first and second inner cells are arranged with respect to one another along the heightwise direction of the cellular shade directly between said first and second junction lines.

16. The cellular shade of claim 14, wherein;

said first inner web corresponds to a single continuous first inner web and said second inner web corresponds to a single continuous second inner web; and said first inner web is separate from said second inner web.

17. The cellular shade of claim 14, wherein said first and second inner webs are further coupled to each other at a junction line positioned between said first and second junction lines.

18. The cellular shade of claim 14, wherein:

said first side cell is defined between said first side gap and said first and second inner cells; and said second side cell is defined between said second side gap and said first and second inner cells.

19. The cellular shade of claim 14, wherein said first and second inner cells are oriented relative to one another within each said outer cell such that differing light transmission bands are formed along the heightwise direction of the cellular shade as light passes therethrough.

20. The cellular shade of claim 14, wherein:

said first junction line is aligned along a single plane defined between each outer cell and a first adjacent outer cell of said plurality of outer cells; and said second junction line is aligned along a single plane defined between each outer cell and a second adjacent outer cell of said plurality of outer cells.

21. A cellular shade for an architectural opening, the cellular shade movable between an extended position and a retracted position, the cellular shade comprising:

a plurality of outer cells arranged vertically with respect to one another, each outer cell of said plurality of outer cells including a first side and a second side extending in a heightwise direction of the cellular shade between a first junction line and a second junction line, said first side defining a portion of a first outer face of the cellular shade and said second side defining a portion of a second outer face of the cellular shade; and at least two inner cells defined within each said outer cell between said first and second junction lines, said at least two inner cells comprising a first inner cell and a second inner cell, said first inner cell forming a substantially closed shape defining a first internal cell area, said second inner cell forming a substantially closed shape defining a second internal cell area, said first and second internal cell areas being substantially exclusive of one another, said first inner cell being formed from a single continuous first inner web and said second inner cell being formed from a single continuous second inner web;

wherein:

said first and second inner cells are arranged with respect to one another in the heightwise direction of the cellular shade;

a first side gap is defined between said first side of each outer cell and said first and second inner cells that extends in the heightwise direction from said first junction line to said second junction line;

a second side gap is defined between said second side of each outer cell and said first and second inner cells that extends in the heightwise direction from said first junction line to said second junction line; and said first inner web is separate from said second inner web.

* * * * *